US005975579A

United States Patent [19]

Iggulden

[11] Patent Number: 5,975,579

[45] Date of Patent: Nov. 2, 1999

[54] PRINTED PUBLICATION WITH CLEANING ARTICLE

[76] Inventor: Jerry Iggulden, 3500 W. Olive Ave. Suite 980, Burbank, Calif. 91505

[21] Appl. No.: 09/102,891

[22] Filed: Jun. 23, 1998

[51] Int. Cl.[6] ..... B42D 15/00

[52] U.S. Cl. ..... 283/61; 206/232; 206/459.5; 229/72; 229/87.5; 229/92.8; 428/321.5; D6/608

[58] Field of Search ..... 283/61; 428/321.5, 428/537.5, 78; 206/232, 459.5; 229/92.8, 87.5, 72; D6/608

[56] References Cited

U.S. PATENT DOCUMENTS

| | | | |
|---|---|---|---|
| D. 329,568 | 9/1992 | Staggs | D6/608 |
| 3,275,316 | 9/1966 | Cleary | 235/55 |
| 4,260,444 | 4/1981 | Fowler . | |
| 4,661,388 | 4/1987 | Charbonneau | 428/43 |
| 4,889,755 | 12/1989 | Charbonneau | 428/42 |
| 4,904,524 | 2/1990 | Yoh | 428/311.3 |
| 4,952,426 | 8/1990 | Guttag . | |
| 4,988,124 | 1/1991 | Hudetz . | |
| 5,094,770 | 3/1992 | Sheridan et al. . | |
| 5,105,941 | 4/1992 | Dolan et al. . | |
| 5,156,843 | 10/1992 | Leong et al. . | |
| 5,160,022 | 11/1992 | Mennella . | |
| 5,161,688 | 11/1992 | Muchin . | |
| 5,188,236 | 2/1993 | Sayers et al. . | |
| 5,197,599 | 3/1993 | Dolan | 206/232 |
| 5,261,531 | 11/1993 | Nieves . | |
| 5,419,958 | 5/1995 | Charboneau | 428/315.5 |
| 5,507,968 | 4/1996 | Palaikis . | |
| 5,639,532 | 6/1997 | Wells . | |
| 5,648,083 | 7/1997 | Bliesner et al. . | |
| 5,798,315 | 8/1998 | Etoh et al. | 428/321.5 |

*Primary Examiner*—Andrea L. Pitts
*Assistant Examiner*—Monica Smith
*Attorney, Agent, or Firm*—Blakely, Sokoloff Taylor & Zafman LLP

[57] ABSTRACT

A cleaner/wipe is provided integrally with a newspaper or other printed publication. The cleaner/wipe may be used for removing printer's ink from the hands of the reader and/or from the reader's clothing or upholstery. In a preferred embodiment, a page or a portion thereof is printed with a modified printer's ink vehicle so that the page or portion thereof can be torn out and used as a wipe. In an alternative embodiment, the wipe may be separately printed or otherwise prepared and then inserted in the printed publication.

9 Claims, 1 Drawing Sheet

PRINTED PUBLICATION WITH CLEANING ARTICLE

BACKGROUND OF THE INVENTION

1. Field of the Invention

The present invention relates generally to the field of personal cleansing products. More particularly, the invention is a wipe for cleaning newsprint and the like from the hands of a reader of a newspaper or other printed publication. The wipe is included as an integral part of the printed publication.

2. Prior Art

It is a common problem while reading a newspaper or other printed publication to have ink transferred to the reader's hands. Often, the publication is being read in a place where there are no convenient hand washing facilities. For example, newspapers are frequently read while commuting to and from work. Ink transferred to a reader's hands is annoying and unsightly and may be transferred to the reader's clothing, furniture or other articles.

Personal cleansing wipes have long been available. Such wipes are marketed, for example, in the form of pre-moistened towelettes packaged in an air-tight pouch. These are well suited to removing ink from a reader's hands, but it is necessary for the reader to have such a wipe handy for use after reading the printed publication.

Methods have been developed for inserting samples of tissues and similar products into newspapers. For example, U.S. Pat. No. 4,260,444 discloses a method of producing a free-standing newspaper insert with a tissue sample attached. The tissue sample can be any form of a thin absorbent tissue, such as toilet tissue, paper toweling, facial tissue or the like. The tissues are inserted between front and back covers. Such an insert was estimated to cost approximately $9.00 per thousand in 1979 dollars. While perhaps cost effective as a product sample, this process is too expensive for routinely providing a hand cleansing article to readers of printed publications.

Accordingly, there is a perceived need for a hand cleansing article that can be inexpensively provided in every copy of a newspaper or other printed publication.

SUMMARY OF THE INVENTION

The present invention comprises a cleaner/wipe that is provided integrally with a newspaper or other printed publication. The cleaner/wipe may be used for removing printer's ink from the hands of the reader and/or from the reader's clothing or upholstery. In a preferred embodiment, a page or a portion thereof is printed with a modified printer's ink vehicle so that the page or portion thereof can be torn out and used as a wipe. In an alternative embodiment, the wipe may be separately printed or otherwise prepared and then inserted in the printed publication.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
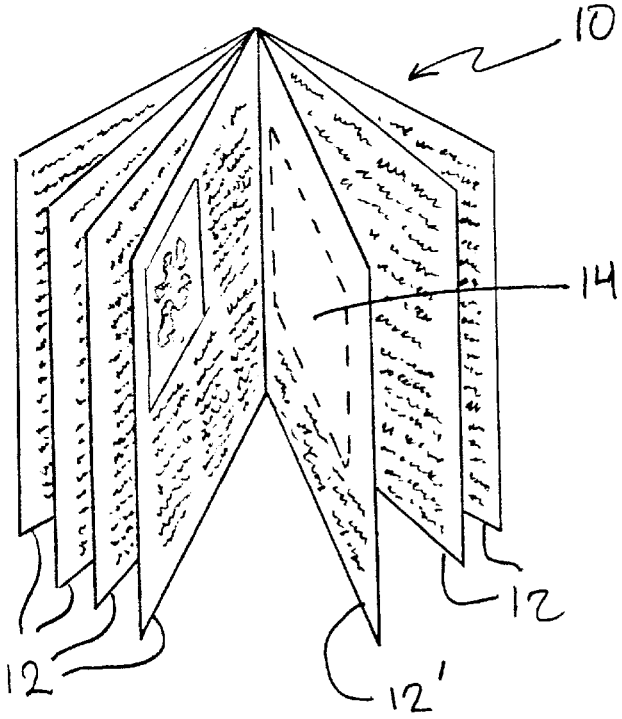
FIG. 1 illustrates a preferred embodiment of the present invention.

FIG. 1 illustrates a newspaper or similar printed publication that has been prepared in accordance with the present invention. Publication 10 comprises a plurality of individual pages 12. Each of pages 12 is typically printed with editorial text, photographs, illustrations, advertising or a combination thereof. The printed matter is applied to pages 12 with an ink, which typically comprises a liquid vehicle carrying pigment, binder and additives. One of the pages, designated as 12', contains an area 14 which appears to be free of printed matter. Area 14 may comprise a portion of page 12' as shown or may comprise the entire page. In either case, it is intended that area 14 be removed from publication 10 for use as a wipe in cleaning the reader's hands. This can be done by simply tearing area 14 from page 12', although perforations may be provided to facilitate the removal.

Area 14 may simply be paper that is free of any printed matter. The clean unprinted paper may then be used as a wipe for removing ink from the reader's hands. Preferably, however, area 14 is treated with a substance that facilitates the cleansing process. The substance may comprise a solvent, detergent or other substance having general purpose cleansing properties or may be a substance that is more specific to the ink used to print the publication. In this latter regard, the substance may comprise the vehicle of the ink with which publication 10 is printed.

Area 14 may be treated in a variety of ways. For example, area 14 may be coated with microcapsules containing a suitable substance. Preferably, however, the substance is printed directly onto area 14 using the same printing process used to apply ink to pages 12. This avoids the added expense of a separate process for treating area 14.

Area 14 may be completely coated with the cleaning substance or may be printed with a pattern of dots, stripes, etc. Printing with a non-continuous pattern offers the benefit of having increased absorbency in the untreated portions of area 14. Thus, the treated portions act to mobilize the ink on the reader's hands while the untreated portions remove the ink.

The substance used to treat area 14 may include components in addition to the ink vehicle. For example, a volatility reducer may be used to ensure that the substance applied to area 14 dries more slowly than the ink applied to pages 12. Furthermore, components such as odorants and skin conditioner may be added.

Figure 2:
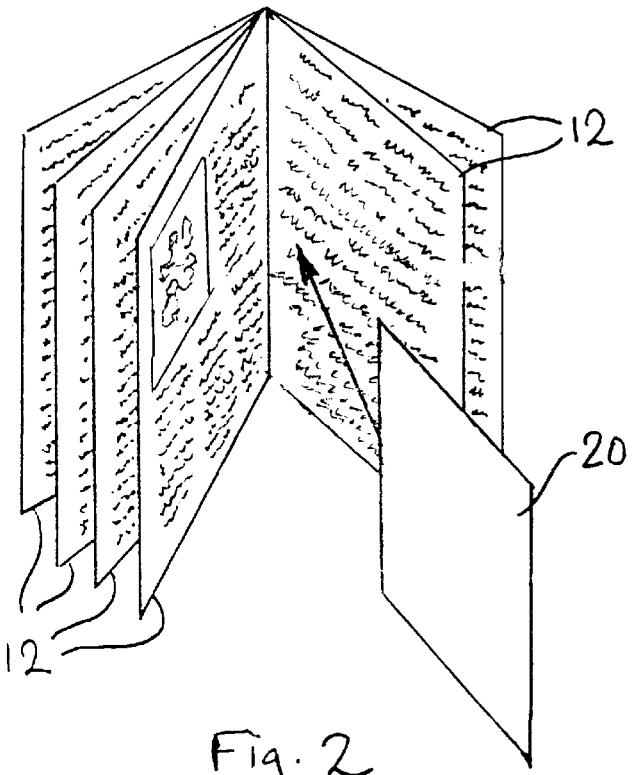
FIG. 2 illustrates an alternative embodiment of the present invention.

FIG. 2 illustrates an alternative embodiment of the present invention. Here, the cleaning article is prepared as an insert 20 which is placed into publication 10. In this embodiment, insert 20 may be treated with a cleansing substance using a process separate from the process used to print publication 10. Insert 10 may thus comprise a substrate different from the paper used for pages 12. For example, insert 20 may be a tissue of woven or non-woven fibers. The cleansing substance may be applied to insert 20 in microcapsules or may be contained in porous fibers within the substrate of insert 20.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A printed publication comprising:

a plurality of pages printed with an ink;

an additional page having at least a portion thereof treated with a substance which is effective in removing the ink from human skin.

2. The printed publication of claim 1 wherein the substance is printed onto said portion of the additional page.

3. The printed publication of claim 1 wherein said portion of the additional page is coated with microcapsules containing the substance.

4. The printed publication of claim 1 wherein the substance comprises a vehicle component of the ink.

5. The printed publication of claim 4 wherein the vehicle comprises mineral oil.

6. The printed publication of claim 4 wherein the substance further comprises a volatility reduce.

7. A printed publication comprising:

a plurality of pages printed with an ink:

an insert in the publication treated with a substance which is effective in removing the ink from human skin, wherein the insert comprises porous fibers containing the substance.

8. A printed publication comprising:

a plurality of pages printed with an ink;

an insert in the publication treated with a substance which is effective in removing the ink from human skin, wherein the substance comprises a vehicle for the ink.

9. The printed publication of claim 8 wherein the vehicle comprises mineral oil.

* * * * *

UNITED STATES PATENT AND TRADEMARK OFFICE

CERTIFICATE OF CORRECTION

PATENT NO. : 5,975,579

DATED : November 2,1999

INVENTOR(S) : Iggulden

It is certified that error appears in the above-identified patent and that said Letters Patent is hereby corrected as shown below:

Item [56], References Cited, U.S. Patent number 5,419,958, please delete inventor name "Charboneau" and insert -- Charbonneau --.

Column 4, line 2, please delete "comprises a volatility reduce" and insert -- comprises a volatility reducer --.

Signed and Sealed this

First Day of May, 2001

*Attest:*

Nicholas P. Godici

NICHOLAS P. GODICI

*Attesting Officer*

*Acting Director of the United States Patent and Trademark Office*